US006740134B2

(12) United States Patent
Angelico et al.

(10) Patent No.: US 6,740,134 B2
(45) Date of Patent: May 25, 2004

(54) USE OF A NATURAL OIL BYPRODUCT AS A REDUCED-EMISSIONS ENERGY SOURCE

(75) Inventors: Paul J. Angelico, Norfolk, MA (US); James E. Ricci, Haverhill, MA (US)

(73) Assignee: Twin Rivers Technologies, L.P., Quincy, MA (US)

( * ) Notice: Subject to any disclaimer, the term of this patent is extended or adjusted under 35 U.S.C. 154(b) by 0 days.

(21) Appl. No.: 09/939,225

(22) Filed: Aug. 24, 2001

(65) Prior Publication Data

US 2003/0037537 A1 Feb. 27, 2003

(51) Int. Cl.[7] ..... C10L 1/18
(52) U.S. Cl. ..... 44/307; 431/2; 44/385
(58) Field of Search ..... 44/307, 385; 431/2

(56) References Cited

U.S. PATENT DOCUMENTS 3,923,702 A * 12/1975 Sturwold et al. ..... 508/135
4,159,992 A 7/1979 Miserlis ..... 260/412.6
4,342,656 A * 8/1982 Walsh ..... 210/770
4,892,560 A * 1/1990 Sial ..... 44/301
5,004,533 A 4/1991 Kalnes et al. ..... 208/50
5,892,072 A 4/1999 Thode ..... 554/175
6,017,371 A 1/2000 Gheysens et al. ..... 44/448
6,129,773 A 10/2000 Killick et al. ..... 44/388
6,193,766 B1 * 2/2001 Jordan ..... 44/308
6,210,452 B1 4/2001 Su ..... 44/410
6,238,551 B1 5/2001 Sherman et al. ..... 208/181

* cited by examiner

*Primary Examiner*—Cephia D. Toomer
(74) *Attorney, Agent, or Firm*—Mintz, Levin, Cohn, Ferris, Glovsky and Popeo, P.C.

(57) ABSTRACT

A natural oil byproduct, which can be produced as a "still bottoms" byproduct of a distillation of a feed composition including an animal fat and/or vegetable oil, is used as an energy source. The natural oil byproduct can comprise unhydrolyzed fat/oil and free fatty acids; and its emissions upon burning have substantially-reduced pollutant concentrations relative to other fuels. When used as an energy source, the natural oil byproduct can be burned alone or in combination with a traditional fuel, such as number 2 or number 6 oil or coal.

17 Claims, 2 Drawing Sheets

USE OF A NATURAL OIL BYPRODUCT AS A REDUCED-EMISSIONS ENERGY SOURCE

BACKGROUND

The ecological importance of clean air is as evident as our need to breathe. Nevertheless, the demands of an industrialized society and the consequent burning of fuel for energy tends to compromise air quality. Existing fuels that are burned in boiler systems to produce steam for heating and power supply include distillate (number 2) fuel oil, residual (number 6) fuel oil, blended distillate and residual fuel oil, and coal. These fuels typically release substantial quantities of harmful pollutants, such as sulfur oxides, nitrogen oxides and carbon monoxide. Moreover, each of these fuels is subject to supply shortages as societal energy demands increase. In fact, dwindling mineral oil reserves are a primary factor in the ongoing energy-supply crisis.

Clean air legislation, such as the Clean Air Act in the United States, has been enacted to control the amount of various chemicals released into the atmosphere in an effort to protect human health and the environment. At a local or regional level, industry is typically regulated by state environmental protection agencies that set limits as to the amounts of airborne pollutants that can be emitted from a given facility.

Many existing energy sources, particularly mineral oils (e.g., petroleum-based fuels), release substantial amounts of pollutants, such as nitrogen oxides ($NO_x$), sulfur oxides ($SO_x$), carbon monoxide (CO) and particulate matter (PM) upon burning. These pollutants cause respiratory diseases, other human ailments and, over time, death. These pollutants also poison the environment via acid rain, ground-level ozone and greenhouse-gas-induced global warning.

As energy demands increase, the pressures, conflicts and costs involved in supplying that energy without exacerbating these health and environmental problems and in complying with clean air regulations become increasingly pressing.

SUMMARY

Embodiments of the present invention are directed to methods for producing energy with substantially-reduced pollutant concentrations of $NO_x$, $SO_x$, CO, and PM in the resultant gaseous emissions. Moreover, these methods utilize, as an energy source, a byproduct of natural fatty-acid manufacturing.

The byproduct that is used in embodiments of the invention is a natural oil byproduct. The natural oil byproduct can be produced by vaporizing a natural fatty-acid composition from a feed composition including an animal fat and/or vegetable oil in a distillation process, wherein the feed composition is first hydrolyzed to remove glycerine. The feed composition (also referred to as a "natural oil composition") can be in a rendered, crude or refined form. The natural oil byproduct can then be processed and burned, either alone or mixed with another energy source, to release energy that is then harnessed to drive a process, such as boiling water in the furnace of a boiler to produce steam.

The natural oil byproduct can include free fatty acid and unhydrolyzed fats/oils as primary constituents. The terms, "fat" and "oil," are generally used interchangeably herein. The term, "fat," is generally used in reference to animal products, while the term, "oil," is generally used in reference to vegetable products. However, recitations of either "fat" or "oil," as in "natural oil byproduct," can refer to a byproduct of either animal fat or vegetable oil or a combination of the two. Likewise, recitation of an "unhydrolyzed fat/oil" refers to an unhydrolyzed animal fat, an unhydrolyzed vegetable oil or a combination of the two.

The natural oil byproduct can also include unsaponifiable impurities and oxidized, polymerized fatty materials, typically at concentrations that are substantially smaller than those of the free fatty acids and unhydrolyzed fats/oils. In one embodiment, the natural oil byproduct comprises about 20% to about 50% free fatty acid, about 20% to about 60% unhydrolyzed fat/oil, about 2% to about 5% unsaponifiable impurities and about 2% to about 7% oxidized, polymerized fatty materials, wherein all percentages are by weight. The fatty acid that is vaporized during distillation can be at least about 90% of the initial composition, by weight. Due to the nature of the natural oils from which it is derived, the natural oil byproduct, unlike byproducts of petroleum and other mineral oils, can be substantially free (allowing for trace impurities) of sulfur compounds, nitrogen compounds and volatile organic compounds. In particular embodiments, the natural oil can be coconut oil, soybean oil, canola oil, sunflower oil, linseed oil, tallow and animal greases.

The invention also resides in selling the natural oil byproduct to industry or to others for use as a fuel, the fuel providing the user with the surprising and previously-unrecognized benefits of reduced pollutant emissions.

By substituting the natural oil byproduct, in whole or in part, for another fuel (such as number 2 fuel oil, number 6 fuel oil, coal and combinations thereof), an energy producer can achieve a substantial decrease in the emission of nitrogen oxides, sulfur oxides, carbon monoxide and particulate matter. Particular advantages can be achieved by substituting the natural oil byproduct for the other fuel(s) in situations where a desired level of energy production cannot be achieved using only the other fuel(s) without violating pollutant-emission levels established by a regulatory agency. Pollutant-emission levels can be maintained at or below regulated limits by evaluating the respective emission concentrations from the natural oil byproduct and from the other fuel(s) and calculating the concentration ratio of the byproduct and the fuel(s) that will produce desired emission concentrations, wherein the resultant emission concentrations will be a proportional function of the respective emission concentrations for the different fuels.

Figure 1:
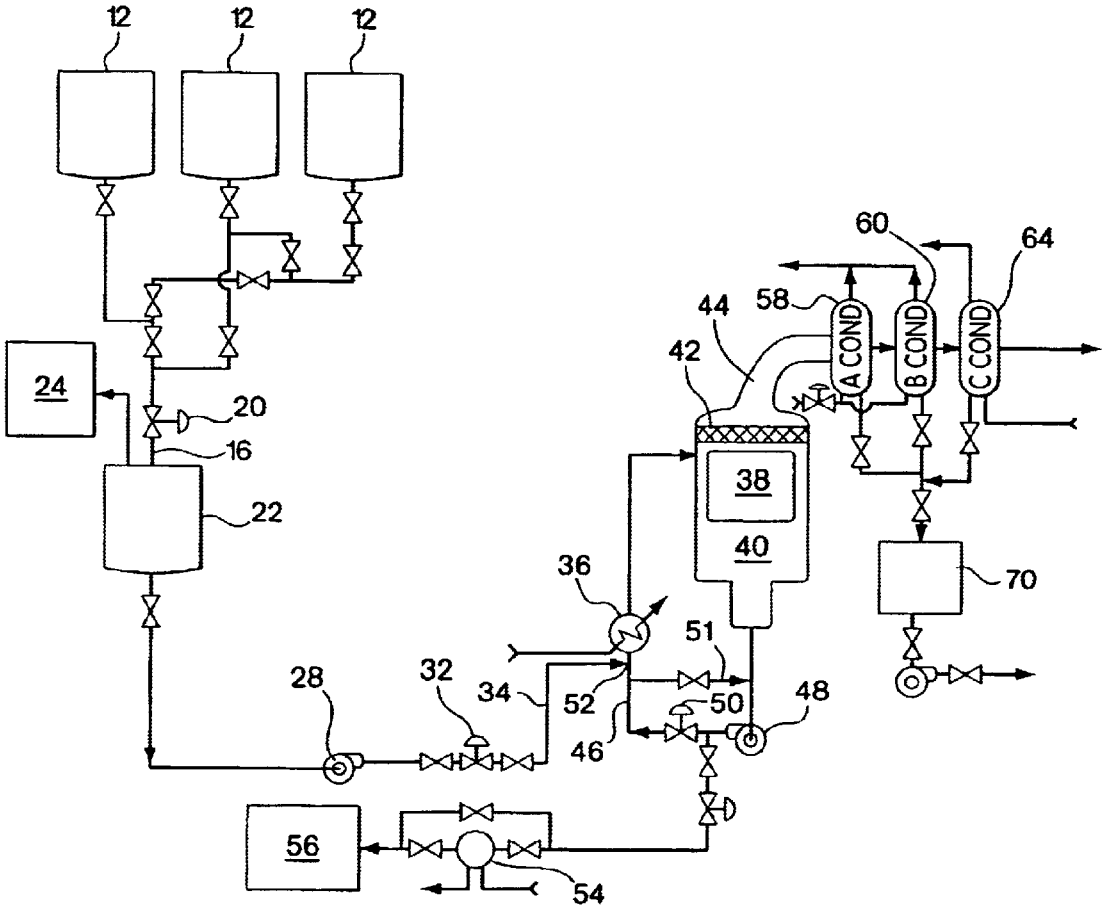
FIG. 1 is a schematic drawing of a still apparatus used to produce the natural oil byproduct.

The foregoing and other features and advantages of the invention will be apparent from the following, more-particular description. In the accompanying drawings, like reference characters refer to the same or similar parts throughout the different views. The drawings are not necessarily to scale, emphasis instead being placed upon illustrating particular principles, discussed below.

DETAILED DESCRIPTION

A "natural oil byproduct" is a composition derived from a natural oil (feed) composition during distillation. The natural oil composition typically is first hydrolyzed, in accordance with known methods of hydrolysis, to remove glycerine. The natural oil composition is then distilled to separate fatty acids, usually of preferred chain lengths (e.g., C 8–18) from the natural oil composition for various final product applications such as soaps, detergents, softeners, rubber and lubricants. These fatty acids are vaporized from the natural oil composition, leaving behind a natural oil byproduct, also known as "still bottoms" or "tailings."

These procedures can be carried out in accordance with known methods for deriving fatty acids for forming soap and other final products. Examples of methods for deriving fatty acids for forming soap are described in U.S. Pat. No. 5,892,072 and in U.S. Pat. No. 4,159,992, both of which are incorporated herein by reference in their entirety. The use of similar methods to derive fatty acids has often been tailored such that at least 90% of the natural oil composition is vaporized in the distillation process. In previous methods, the still bottoms were essentially viewed as a waste product in soap-making processes, though they were sometimes used as a low-cost animal feed additive. The still bottoms typically include unhydrolyzed fat/oil and high-molecular-weight impurities that were present in the natural oil composition.

Separation of the natural oil byproduct from the vaporized fatty-acid composition in the distillation process makes a marked improvement in the color and the odor of the vaporized fatty acid. The natural oil byproduct would likewise have an adverse effect on the color and odor stability of soap and other fatty-acid final products. Consequently, the distillation process makes it possible to make high-quality final products from lower-quality raw materials than would be possible if distillation were not used to clean up the fatty acid.

Figure 2:
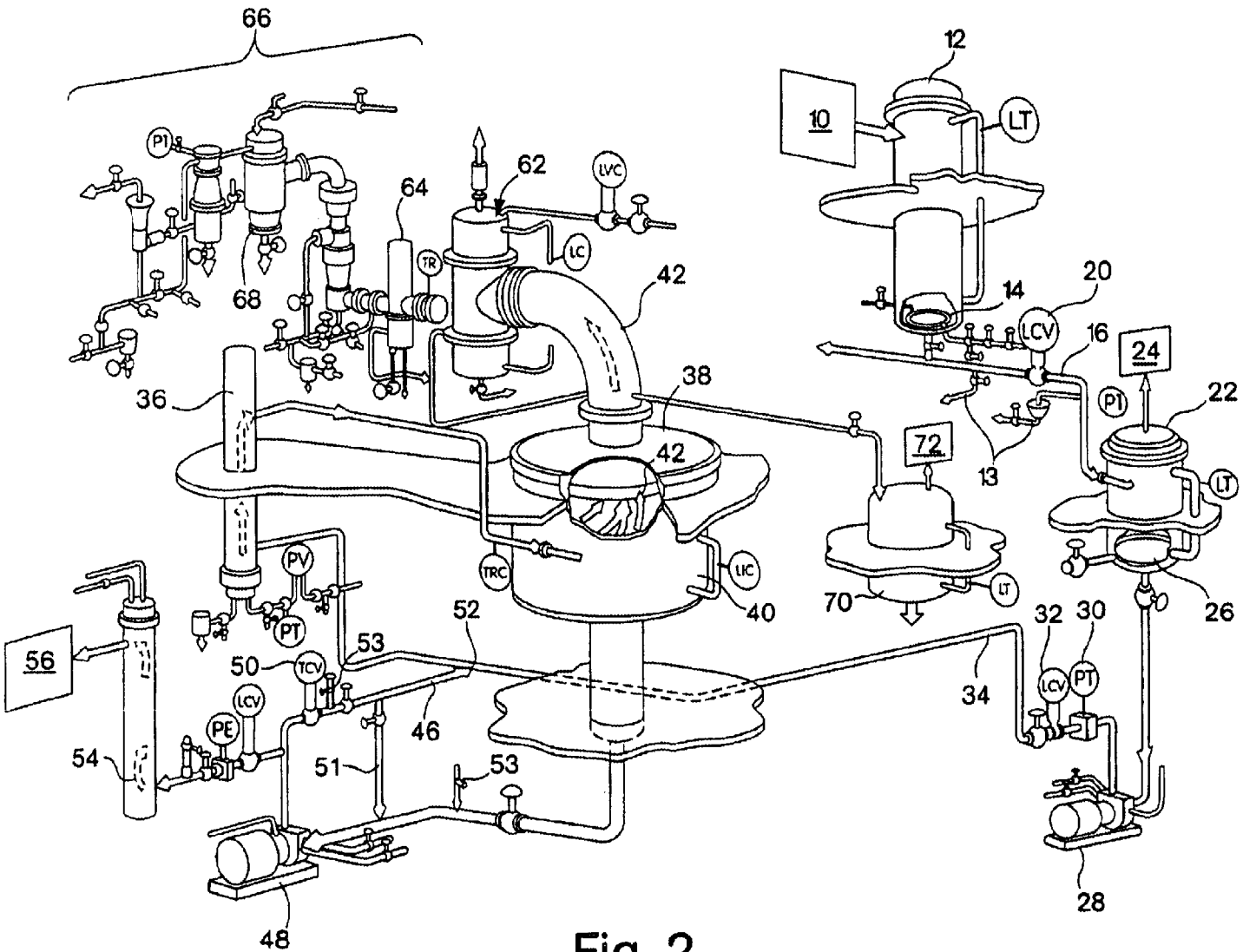
FIG. 2 is a partially-schematic perspective drawing illustrating various components of a still apparatus, much like that of FIG. 1, used to produce the natural oil byproduct.

A distillation system for separating a high-grade fatty acid composition from a natural oil byproduct is illustrated in FIG. 1, and another is shown in FIG. 2. These drawings illustrate two particular embodiments of apparatus for producing a natural oil byproduct; however, these embodiments are intended to be merely illustrative; and the broader aspects of the invention, relating to the production of the natural oil byproduct, are not intended to be limited to the use of the particular apparatus illustrated.

The distillation process is simply a physical separation of the normally desirable fatty acid products from the normally undesirable natural oil byproducts that are present in the natural oil composition. Distillation is performed by converting fatty acids to vapor, thereby separating the vaporized fatty acids from the natural oil byproducts, which remain in liquid form, and then condensing the fatty acid vapors (converting the vapors back to liquid).

The distillation process begins at a flash tank 10 (shown schematically in FIG. 2). The flash tank 10 is a hydrolyzer column, wherein a composition having a high concentration of fatty acids is derived from a composition comprising natural oil, such as coconut oil and/or tallow; in this embodiment, the fatty-acid composition rises to the top of the hydrolyzer column under pressure and high temperature. When the pressure of the fatty-acid composition is then dropped to atmospheric pressure, most of the dissolved water boils off. This partially-dried, fatty-acid composition is then transported from the flash tank 10 to a still feed tank 12, which functions as a wide spot in the line and provides surge storage. In the embodiment of FIG. 1, multiple still feed tanks 12 are connected in parallel with the still feed apparatus. The feed is heated in the still feed tank 12 via a steam-heated coil 14 (shown in FIG. 2) at the base of the tank 12. Depending on the source, the steam-heated coil 14 may be at a temperature in the range of 100° to 300° F. (38° to 149° C.).

From the still feed tank 12, the fatty-acid composition is transported through a pipe 16 to a vacuum dryer 22. Coupled with the pipe 16 between the still feed tank 12 and vacuum dryer 22 are moisture drains 18 (shown in FIG. 2) and a level control valve 20, respectively used to drain moisture from the feed and to control flow. The vacuum dryer 22 is coupled with a vacuum 24 and can be heated via a steam-heated coil 26, with the steam, in one embodiment, at 150 pounds pressure and at 200° F. (93° C.). Under the vacuum of the vacuum dryer 22, most of the remaining water in the stock boils off.

The dried, fatty-acid composition, which is still a liquid, is then pumped via pump 28 from the vacuum dryer 22 through a flow transmitter 30 and level control valve 32 (shown in FIG. 2), which collectively regulate flow, through a pipe 34 to a high-pressure heat exchanger 36. The heat exchanger 36 is heated with steam at 800 pounds pressure at about 400° F. (204° C.). The feed then is passed into a large flash still 38. The flash still 38 is a large tank operating under a vacuum, where vaporized fatty acid at its boiling point separates (flashes) from the liquid material in the feed. The fatty-acid composition enters the still 38 through a nozzle directed along the inside wall of the still pot 40. This type of injection (referred to as tangential entry) causes the hot stock to swirl and fan out along the inside wall of the still pot 40, thus exposing a large surface area for evaporation. The still pot 40 is equipped with a knit mesh entrainment separator 42 covering the vapor line 44 leaving the still pot 40. The knit mesh entrainment separator 42 traps droplets of liquid in the vapor and returns the liquid to the still pot 40.

The portion of the raw feed that does not evaporate upon injection into the still 38 collects in the bottom of the pot 40 as "still bottoms." The still bottoms are pumped through recycle loop 46 via pump 48 through a level control valve 50 from the bottom of the still pot 40. The recycled still bottoms are then mixed with new raw feed coming into the system at juncture 52, passed through the heat exchanger 36, and reinjected into the still 38. Approximately 8 pounds (3.6 kg) of this material, referred to as still bottoms or natural oil byproduct, is recycled for every 1 pound (0.45 kg) of new raw feed entering the system. When the level of the natural oil byproduct in the still pot 40 builds to above the desired operating level, the natural oil byproduct is removed from the recycle loop 46, cooled in a water-cooled heat exchanger 54 and diverted to dedicated storage 56. Pipe 51 is used as a bypass around the pump 48 at startup. Steam inputs 53 (shown in FIG. 2) are used in the pipes to clear them during brand changeovers.

The natural oil byproduct typically includes from about 20% to about 50% (nominally 30%) free fatty acid, from about 20% to about 70% (nominally 60%) unhydrolyzed fat/oil, from about 2% to about 5% (nominally 4%) unsaponifiable impurities (materials other than fat or oil, such as plastics and metals, that do not boil), and from about 2% to about 7% (nominally 6%) oxidized, polymerized fatty materials. The particular composition of the natural oil byproduct will be a function of the composition of the natural-oil composition as well as the parameters of the distillation process. From storage 56, the natural oil byproduct is loaded into either railcars or trucks or transferred directly for delivery to customers or internally for use as an energy source.

The fatty acid vapor that passes through the entrainment separator flows into a group of condensers. The first of these condensers, which condenses the bulk of the product, is cooled with boiling water. In the system of FIG. 1, the boiling water condensers are separate and are referred to as an "A" condenser 58 and a "B" condenser 60. The generated steam from these condensers is recycled back to the boiler house. In the system of FIG. 2, the function of the A and B condenser has been combined into a single unit described as a combined "A-B" condenser 62. The final condenser in the group is referred to as a "C" condenser 64. The C condenser 64 is cooled with 120° water. At the temperatures present in the C condenser 64, short-chain fatty acids, which stay in the vapor passing through the A and B condensers, are condensed. By condensing these short-chain, very-volatile, fatty acids, the load on the ejector system 66 (shown in FIG. 2) can be minimized. Any fatty acid that gets past the C condenser 64 is condensed in the barometric condenser 68 and ends up in the barometric hot well. Usually, the fat collected in the barometric hot well ends up in an accumulations tank. The condensed fatty acid distillate from all three condensers is collected in a distillate receiver 70 coupled with a vacuum source 72. From the distillate receiver 70, the distilled product can be cooled and sent to storage or to subsequent processing before being used to form soap or other final products.

An energy producer (e.g., a boiler operator) can substitute the natural oil byproduct, in whole or in part, for another fuel, such as number 2 fuel oil, number 6 fuel oil, coal and combinations thereof, as an energy source to be burned in the furnace of the boiler. In so doing, the energy producer can achieve a substantial decrease in the amount of nitrogen oxides, sulfur oxides, carbon monoxide and particulate matter emitted as a consequence of burning the fuels. In some situations, a desired level of energy production cannot be achieved using only a combination of number 2 and number 6 fuel oil, for example, without violating regulated pollutant-emission limitations.

The energy produced by the natural oil byproduct is competitive with that produced by other fuel sources. A sampling of batches of natural oil byproduct, produced in accordance with the methods described above, showed an average of approximately 130,000 BTU/gallon for the natural oil byproduct. The energy produced by number 6 oil is somewhat higher (typically about 150,000 BTU/gallon), while the energy produced by number 2 oil is almost the same (typically about 135,000 BTU/gallon). Depending on the particular ingredients in the feed composition and the parameters of the distillation process, the energy produced by the natural oil byproduct may be somewhat higher or lower in other embodiments. Regardless, the natural oil byproduct can produce nearly as much energy as these traditional fuels at much lower pollutant-emission levels.

Experimental

Measurements were taken of boiler stack emissions from the burning of two separate energy-sources. The first energy source was a mix of 80% number 6 fuel oil and 20% number 2 fuel oil. The second energy source was a 100% concentration of a natural oil byproduct produced via the methods described above from a natural-oil composition comprising tallow and coconut oil.

The two energy sources were separately burned in the furnace of a boiler. The emissions from the boiler for the natural oil byproduct showed the following reductions compared with the emissions for the composition comprising 80% number 6 fuel oil and 20% number 2 fuel oil:

66% reduction in $NO_x$,

88% reduction in $SO_x$,

100% reduction in CO, and

78% reduction in PM.

While this invention has been shown and described with references to particular embodiments thereof, those skilled in the art will understand that various changes in form and details may be made therein without departing from the scope of the invention, which is limited only by the following claims.

What is claimed is:

1. A method for generating energy via clean-emissions burning of a natural oil byproduct comprising the steps of:

vaporizing a fatty acid composition via distillation from a feed composition including at least one of an animal fat and a vegetable oil, leaving a non-vaporized natural oil byproduct comprising about 20% to about 50% by weight free fatty acid and from about 20% to about 70% by weight unhydrolyzed fat/oil;

burning the natural oil byproduct to release energy; and harnessing energy released by burning the natural oil byproduct to drive a process.

2. The method of claim 1, wherein the natural oil byproduct further comprises about 2% to about 5% by weight unsaponifiable impurities and about 2% to about 7% by weight oxidized, polymerized fatty materials.

3. A method for generating energy via clean-emissions burning of a natural oil byproduct comprising the steps of:

vaporizing a fatty acid composition via distillation from a feed composition including at least one of an animal fat and a vegetable oil, leaving a non-vaporized natural oil byproduct, wherein the vaporized fatty acid composition is at least about 90% of the initial feed material by weight;

burning the natural oil byproduct to release energy; and harnessing energy released by burning the natural oil byproduct to drive a process.

4. A method for generating energy via clean-emissions burning of a natural oil byproduct comprising the steps of:

burning a natural oil byproduct comprising about 20% to about 40% by weight free fatty acid and from about 20% to about 70% by weight unhydrolyzed fat/oil to release energy, wherein the natural oil byproduct is the unvaporized remnant of a natural oil composition after fatty acids are separated from the natural oil byproduct via distillation; and harnessing energy released by burning the natural oil byproduct to drive a process.

5. The method of claim 4, wherein the natural oil byproduct is burned in a furnace in which the natural oil byproduct is substituted, in whole or in part, for another type of fuel, the substitution of the natural oil byproduct producing a decrease in the emission of at least one pollutant chosen from nitrogen oxides, sulfur oxides, carbon monoxide and particulate matter.

6. The method of claim 5, wherein the fuel for which the natural oil byproduct is substituted is chosen from distillate number 2 fuel oil, residual number 6 fuel oil, and coal.

7. A method for generating energy via clean-emissions burning of a natural oil byproduct comprising the steps of:

burning a natural oil byproduct comprising about 20% to about 40% by weight free fatty acid and from about 20% to about 70% by weight unhydrolyzed fat/oil to release energy, wherein the natural oil byproduct is burned in a furnace in which the natural oil byproduct is substituted, in whole or in part, for another type of fuel, and wherein the substitution of the natural oil byproduct for the other fuel reduces the emission of at least one pollutant chosen from nitrogen oxides, sulfur oxides, carbon monoxide and particulate matter to a level that provides a benefit under pollution-emission regulation established by a regulatory agency compared with; burning the fuel without the natural oil byproduct to produce the same amount of energy; and harnessing energy released by burning the natural oil byproduct to drive a process.

8. A method for generating energy via clean-emissions burning of a natural oil byproduct comprising the steps of:

burning a natural oil byproduct comprising about 20% to about 40% by weight free fatty acid, from about 20% to about 70% by weight unhydrolyzed fat/oil, about 2% to about 5% by weight unsaponifiable impurities and about 2% to about 7% by weight oxidized, polymerized fatty materials to release energy; and harnessing energy released by burning the natural oil byproduct to drive a process.

9. The method of claim 4, wherein the natural oil byproduct is substantially free of sulfur compounds and nitrogen compounds.

10. The method of claim 4, wherein the natural oil byproduct is burned in a furnace of a boiler.

11. The method of claim 4, wherein the natural oil byproduct is mixed with at least one fuel chosen from distillate number 2 fuel oil, residual number 6 fuel oil, and coal before burning.

12. The method of claim 7, wherein the emission of pollutant(s) is reduced to a level within a limit established by a regulatory agency, wherein burning the fuel without the natural oil byproduct to produce the same amount of energy would emit one or more pollutants at a concentration above the established limit.

13. The method of claim 1, wherein the natural oil byproduct is burned in a furnace in which the natural oil byproduct is substituted, in whole or in part, for another type of fuel, and wherein the substitution of the natural oil byproduct for the other fuel reduces the emission of at least one pollutant chosen from nitrogen oxides, sulfur oxides, carbon monoxide and particulate matter to a level that provides a benefit under pollution-emission regulation established by a regulatory agency compared with burning the fuel without the natural oil byproduct to produce the same amount of energy.

14. The method of claim 3, wherein the natural oil byproduct is burned in a furnace in which the natural oil byproduct is substituted, in whole or in part, for another type of fuel, and wherein the substitution of the natural oil byproduct for the other fuel reduces the emission of at least one pollutant chosen from nitrogen oxides, sulfur oxides, carbon monoxide and particulate matter to a level that provides a benefit under pollution-emission regulation established by a regulatory agency compared with burning the fuel without the natural oil byproduct to produce the same amount of energy.

15. The method of claim 4, wherein the natural oil byproduct is burned in a furnace in which the natural oil byproduct is substituted, in whole or in part, for another type of fuel, and wherein the substitution of the natural oil byproduct for the other fuel reduces the emission of at least one pollutant chosen from nitrogen oxides, sulfur oxides, carbon monoxide and particulate matter to a level that provides a benefit under pollution-emission regulation established by a regulatory agency compared with burning the fuel without the natural oil byproduct to produce the same amount of energy.

16. The method of claim 5, wherein the substitution, in whole or in part, of the natural oil byproduct reduces the emission level for one or more of the pollutants to a level that provides a benefit under pollution-emission regulation established by a regulatory agency compared with burning the fuel without the natural oil byproduct to produce the same amount of energy.

17. The method of claim 8, wherein the natural oil byproduct is burned in a furnace in which the natural oil byproduct is substituted, in whole or in part, for another type of fuel, and wherein the substitution of the natural oil byproduct for the other fuel reduces the emission of at least one pollutant chosen from nitrogen oxides, sulfur oxides, carbon monoxide and particulate matter to a level that provides a benefit under pollution-emission regulation established by a regulatory agency compared with burning the fuel without the natural oil byproduct to produce the same amount of energy.

* * * * *

UNITED STATES PATENT AND TRADEMARK OFFICE

CERTIFICATE OF CORRECTION

PATENT NO. : 6,740,134 B2
DATED : May 25, 2004
INVENTOR(S) : Paul J. Angelico and James E. Ricci It is certified that error appears in the above-identified patent and that said Letters Patent is hereby corrected as shown below:

Column 7,
Line 1, remove the semicolon between “with” and “burning”.

Signed and Sealed this

Twenty-first Day of December, 2004

JON W. DUDAS
*Director of the United States Patent and Trademark Office*